US005611715A

United States Patent [19]

Samejima

[11] Patent Number: 5,611,715

[45] Date of Patent: Mar. 18, 1997

[54] ELECTRIC CONNECTING DEVICE

[75] Inventor: Masakuni Samejima, Shizuoka, Japan

[73] Assignee: Yazaki Corporation, Tokyo, Japan

[21] Appl. No.: 364,273

[22] Filed: Dec. 27, 1994

[30] Foreign Application Priority Data

Dec. 27, 1993 [JP] Japan ..... 5-347128

[51] Int. Cl.[6] ..... H01R 11/22

[52] U.S. Cl. ..... 439/850; 439/851

[58] Field of Search ..... 439/850, 748, 439/266, 637, 849, 851

[56] References Cited

U.S. PATENT DOCUMENTS

| | | | |
|---|---|---|---|
| 3,149,899 | 9/1964 | Johanson | 439/637 |
| 4,472,017 | 9/1984 | Sian | 439/850 |
| 4,629,267 | 12/1986 | Stepan | 439/850 |
| 4,781,628 | 11/1988 | Detter et al. | 439/850 |

FOREIGN PATENT DOCUMENTS

| | | | |
|---|---|---|---|
| 55-36528 | 3/1980 | Japan | H01R 13/11 |
| 59-59474 | 4/1984 | Japan | H01R 4/24 |
| 62-13757 | 8/1987 | Japan . | |
| 62-137575 | 8/1987 | Japan | H01R 13/115 |

*Primary Examiner*—David L. Pirlot
*Assistant Examiner*—Eugene G. Byrd
*Attorney, Agent, or Firm*—Sughrue, Mion, Zinn, Macpeak & Seas

[57] ABSTRACT

A resilient connecting part of an electric connecting device is formed by folding back one sheet of metal base into a multilayer, so that the maximum displacement of the resilient connecting part is regulated according to the thickness of the metal base, the number of layers (3 layers) and layer-to-layer gaps.

3 Claims, 3 Drawing Sheets

ELECTRIC CONNECTING DEVICE

BACKGROUND OF THE INVENTION

1. Field of the Invention

The present invention relates to an electric connecting device for use as a electric connector or an intermediate electric connector that joints electric conductors to the terminal of electric equipment, and more particularly to an electric connecting device that provides suitable contact pressure while preventing plastic deformation from being caused by interference with the counterpart terminal connected for electric conduction.

2. Related Art

FIGS. 5–7 are block diagrams of an electric connecting device that has heretofore been used. More specifically, an electric connecting device 1 is called a female terminal and provided with a terminal connecting section 2 on the front end side and a cable connecting section 3 on the rear end side. The terminal connecting section 2 has a rectangular outer wall 4 and a resilient connecting part 6 which is formed by folding back a metal base 5.

Further, the cable connecting section 3 includes a retaining part 8 for fastening a cable 7 tight to prevent it from slipping out of its sheath and a solderless terminal 9 which is forced to stick to the conductors when it is tightened. In this case, the retaining part 8 and the solderless terminal 9 shown in these drawings are those in such a state that they are before being folded and tightened for retaining purposes.

When a male terminal is connected to the electric connecting device 1, the external terminal 10 is pushed in the direction of an arrow A as shown by an imaginary line of FIG. 6 so that it comes into contact with the resilient connecting part 6. Although the resilient connecting part 6 is deformed as shown in FIG. 6 when the external terminal 10 is pushed in, it is still forced to contact the external terminal 10 by its own resiliency to make current flow therethrough.

Incidentally, Japanese Unexamined Utility Model Publications No. 36528/1980, No. 59474/1984, No. 137575/1987 and so forth also disclose connecting structures similar to the electric connecting device 1.

When the external terminal 10 with reference to FIG. 6 is inserted, the resilient connecting part 6 may undergo plastic deformation as shown in FIG. 7, thus failing to return to the original profile, provided that an external terminal having a thickness greater than the standardized one is inserted. In case the external terminal 10 should be permanently deformed, moreover, it may ruin the function of the electric connecting device and may render the element unusable.

However, the provision of a spring reinforcing structure or the projection of a reinforcing plate from the outer wall 2 is hardly possible because the spring space a before the external terminal 10 is inserted moved with the insertion of the external terminal 10. If it is persistently attempted to provide such a reinforcing plate, not only the overall shape of the electric connecting device 1 but also that of the terminal connecting part 2 may become large-sized.

SUMMARY OF THE INVENTION

An object of the present invention is to provide an electric connecting device capable of terminal-to-terminal connection while preventing the plastic deformation of a resilient connecting part without increasing the size of the electric connecting device.

According to an aspect of the present invention, there is provided an electric connecting device for making a counterpart external terminal resiliently contact a resilient connecting part which is formed by folding back a metal base so that the resilient connecting part may induce elastic deformation, wherein the metal base is folded back into a multilayer so as to regulate the maximum displacement of the whole resilient connecting part by the thickness of the multilayered portion of the base metal and the layer-to-layer gaps formed therein.

According to another aspect of the present invention, an electric connecting device is provided for making a counterpart external terminal resiliently contact a resilient connecting part which is formed by folding back a metal base so that the resilient connecting part may induce elastic deformation, wherein the metal base extending in the direction in which the terminal is inserted is folded back at least three times into a multilayer in the form of a flat spiral-wound multilayer so as to regulate the maximum displacement of the whole resilient connecting part by the thickness of the multilayered portion of the base metal and the layer-to-layer gaps formed therein.

According to another aspect of the present invention, at least one layer of the metal base is provided with a protrusion for use in regulating the displacement of the resilient connecting part at the time the external terminal is inserted.

With the electric connecting device whose resilient connecting part is formed by folding back the metal base into a multilayer, the maximum displacement of the resilient connecting part is regulated by the thickness of the base metal, the number of folded-back layers and the layer-to-layer gaps formed therein, whereby not only the contact failure with the external terminal due to plastic deformation but also any increase in the size of the electric connecting device can be prevented.

Since the folded-back layer situated, for example, in the end portion of the folded-back metal base is provided with the protrusion whose height serves to adjust the deformation of the resilient connecting part, no resilient connecting part corresponding to the thickness of the external terminal needs preparing, thus making it possible to improve the freedom of designing and to decrease the number of parts.

BRIEF DESCRIPTION OF THE PREFERRED EMBODIMENTS

DETAILED DESCRIPTION OF THE PREFERRED EMBODIMENTS

Figure 1:
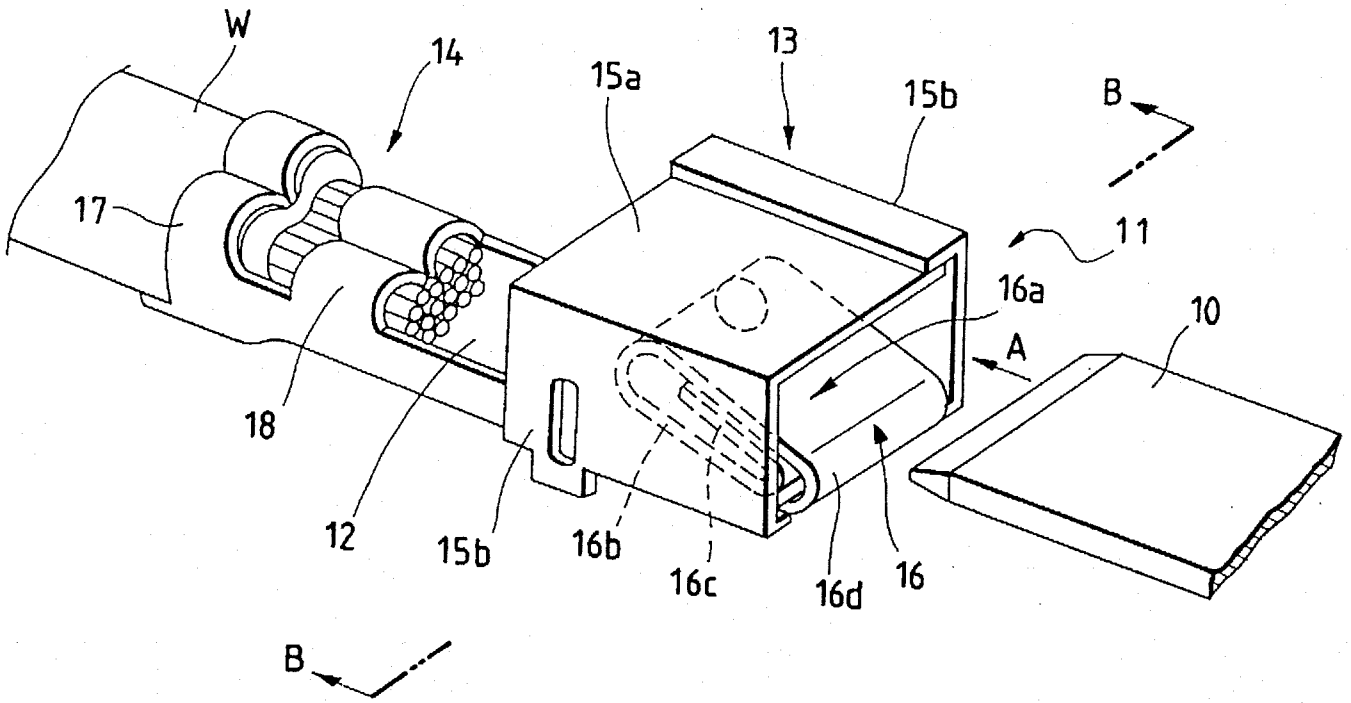
FIG. 1 is a perspective block diagram of an electric connecting device embodying the present invention.
Figure 2:
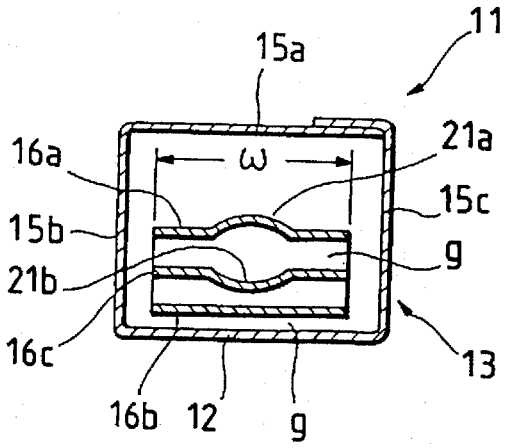
FIG. 2 is a sectional view of the principal part of the electric connecting device according to the present invention.
Figure 3:
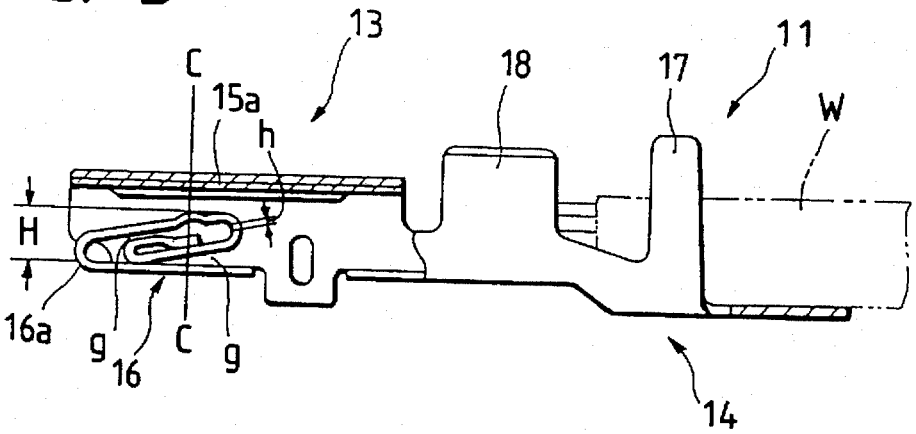
FIG. 3 is a sectional view of the electric connecting device according to the present invention.

Referring to FIGS. 1–4, a detailed description will subsequently be given of an electric connecting device embodying the present invention. FIG. 1 is a perspective block diagram of the electric connecting device; FIG. 2 a sectional view taken on line B—B of FIGS. 1 and 3; FIG. 3 a sectional view of the principal part of the electric connecting device; and FIG. 4 a sectional view of the principal part of a resilient connecting part that has been deformed.

Referring to FIG. 1, the construction of the electric connecting device 11 will be described first. The electric connecting device 11 is integrally formed by blanking or sheeting one sheet of metal base 12 and broadly divided into two parts: a rectangular terminal connecting part 13 and a cable connecting part 14. The terminal connecting part 13 is arranged so that it covers a resilient connecting part 16 which is formed by folding back the metal base 12 with a platelike outer wall 15 and side walls 15*b*, 15*c* located opposite to each other.

The cable connecting part 14 is equipped with a retaining part 17 which is formed by blanking the metal base 12, and a solderless terminal 18. The retaining part 18 is bent to prevent an electric cable W from slipping out, whereas the solderless terminal 18 is used to connect the conductors to the electric connecting device 11 to make them conduct.

In this case, special attention should be given to the construction of the resilient connecting part 16 of the electric connecting device 11. More specifically, the resilient connecting part 16 is formed into a flat swirl-wound profile by bending the metal base 12 once from the opening side toward the terminal connecting part 13 as shown in FIGS. 1 and 2, further bending it toward the opening side, and toward the terminal connecting part 13 as if to wind it by another turn. Therefore, the resilient connecting part 16 has three layers as shown in FIG. 2 at the position where the number of layers of the resilient connecting part 16 is maximized as taken on line C—C.

Since the electric connecting device 11 is thus multilayered, the gaps g between the uppermost layer 16*a* and the end layer 16*c* of the resilient connecting part 16 and between the lowermost layer 16*b* thereof and the metal base 12 are narrowed. Moreover, the width w of the resilient connecting part 16 ranging from the first bent portion 16*d* as the base up to the end layer 16*c* is made equal as shown in FIGS. 1 and 2.

The uppermost layer 16*a* and the end layer 16*c* are provided with an upward protrusion 21*a* and a downward protrusion 21*b*, respectively, both of these protrusions 21*a*, 21*b* being forming by embossing. The protrusion 21*a* is intended to improve its adherence to the external terminal 10 as will be described later and the other protrusion 21*b* improves the strength of the end layer 16*c* and also adjusts the maximum displacement of the resilient connecting part 16 when the external terminal 10 is inserted.

The operation of inserting the external terminal 10 will subsequently be described.

Figure 4:
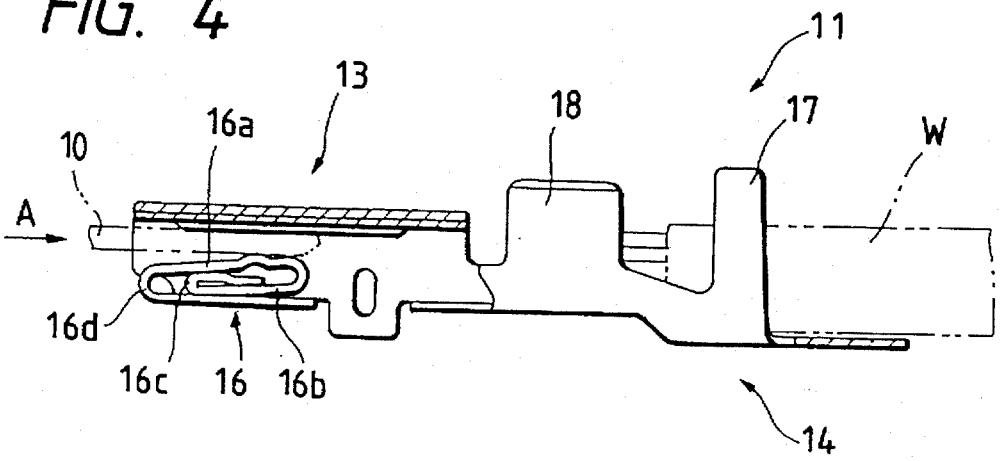
FIG. 4 is a sectional view of a deformed resilient connecting part according to the present invention.
Figure 5:
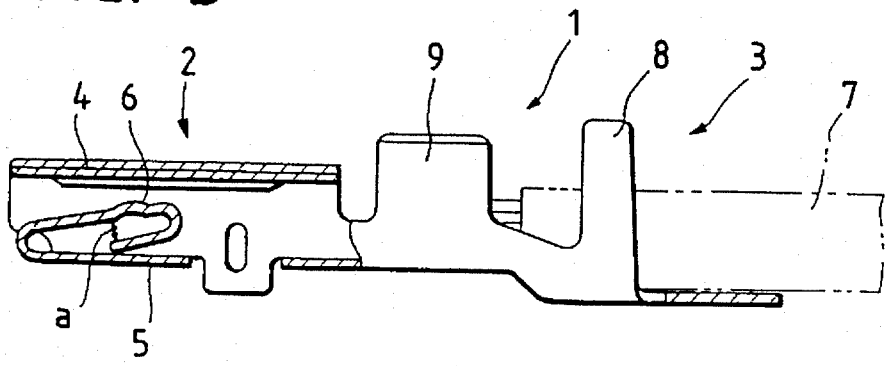
FIG. 5 is a sectional view of the principal part of a conventional electric connecting device.
Figure 6:
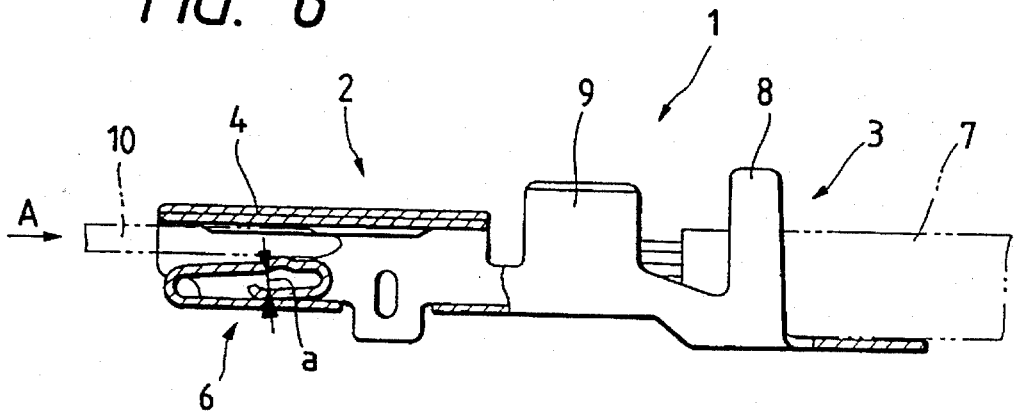
FIG. 6 is a sectional view of a deformed resilient connecting part of the convention electric connecting device.
Figure 7:
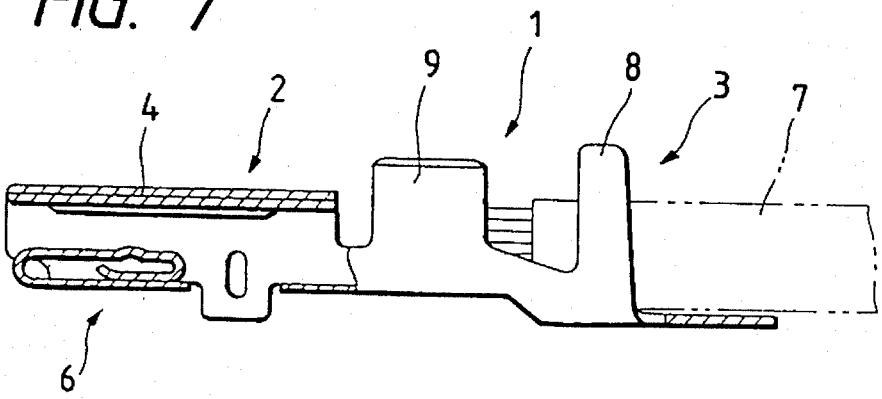
FIG. 7 is a sectional view of the plastic deformation of the resilient connecting part of the conventional electric connecting device.

As shown in FIG. 3, the resilient connecting part 16 has a rising gradient from the opening side toward the inside before the external terminal 10 is inserted. When the external terminal 10 is inserted, the whole resilient connecting part 16 is forced downward as shown in FIG. 4 in proportion to the thickness of the external terminal 10.

Since the gaps g are small, however, the resilient connecting part 16 is lowered by only a very small amount equivalent to the gaps g and is still free from plastic deformation exceeding its maximum displacement. Therefore, the external terminal 10 and the resilient connecting part 16 are kept in intimate contact with each other whenever the former is inserted even though the operation of inserting and extracting it is repeated. Consequently, electrical conduction is accomplished at low contact resistance and this makes the electric connecting device 11 fit for use in equipment such as automotive electrical equipment which requires a large current.

When the operation of inserting and extracting the external terminal 10 is performed, the external terminal 10 may be gouged out. If the external terminal 10 is gouged repeatedly, the lateral side portions of the resilient connecting part 16 may have heretofore been deformed as it is platelike in shape. According to the present embodiment of the invention, however, there are provided three layers over the whole width w and the gap g excluding where the protrusion 21*b* is made constant. Accordingly, the resilient connecting part 16 will never be deformed permanently even if the external terminal 10 is forced out. In other words, the resilient connecting part 16 is allowed to come into intimate contact with the external terminal 10.

Although the thickness of the external terminal 10 varies with the use, the maximum displacement of the resilient connecting part 16 is kept constant as not only the thickness of the layers 16*a*, 16*b*, 16*c* thereof but also the gaps g are constant. With this arrangement according to the present embodiment of the invention, it is therefore possible to obviate the inconvenience caused by the necessity of preparing a number of electric connecting devices 11 different in the maximum displacement which agrees with the thickness of the external terminal 10.

Since the end layer 16*c* is provided with the protrusion 21*b*, adjusting its height g has the same effect of a case where the gap g is adjusted. When the external terminal 10 is thick, for example, the height H of the resilient connecting part 16 is reduced by decreasing the height of the protrusion 21*b* or doing away with embossing it out, whereas when the external terminal 10 is thin, the regulating position is raised by increasing the height of the protrusion 21*b*. External terminals 10 different in thickness can thus be dealt with without changing the thickness of the metal base 12 and the size of the gap g.

The present invention manifests excellent effects in the form of improvement in electric characteristics in that current can smoothly be passed even when external terminals 10 different in thickness are employed, in the freedom of designing, in decreasing the number of parts, in facilitating material management and so forth.

While the preferred form of the present invention has been described, it is to be understood that the invention is not limited to the specific embodiments thereof and various modifications may be made therein. For example, the folded-back profile of the metal base 12 may be completed into the so-called meandering form instead of the winding one.

In the electric connecting device as set forth above, the metal base is folded back into a multilayer to form the resilient connecting part so as to regulate the maximum displacement of the resilient connecting part according to the thickness of the base metal, the number of layers and the layer-to-layer gaps formed therein.

When the external terminal is inserted and caused to contact the resilient connecting part, it is possible to make the contact of the resilient connecting part with the external terminal satisfactory and to make the smooth passage of current last for a long time without increasing the size of the connecting element as the resilient connecting part is free from plastic deformation with the effect of preventing the resiliency of the resilient connecting part from being damaged and improving the reliability of electric equipment. Moreover, the protrusions are formed on the folded-back layer so as to regulate the displacement of the resilient connecting part by adjusting their height, whereby excellent resiliency becomes obtainable, irrespective of the thickness of the external terminal. Consequently, it is unnecessary to provide such a resilient connecting part as what corresponds to the thickness of the external terminal, which manifests excellent effects in the form of improvement in the freedom of designing, in decreasing the number of parts, in facilitating material management and so forth.

What is claimed is:

1. An electric connecting terminal comprising:

a base member; and a multilayer resilient connecting portion for resiliently contacting a male terminal to be inserted in the electric connecting terminal, wherein the resilient connecting portion comprises a portion of the base member that is folded back over itself at least three times to form at least three layers for regulating a maximum displacement of the resilient connecting portion in accordance with a thickness of the base member at the resilient connecting portion and gaps formed between each layer of the resilient connecting portion.

2. An electric connecting terminal as recited in claim 1, wherein at least one layer of the resilient connecting portion comprises a protrusion for regulating the maximum displacement of the resilient connecting portion when the male terminal is inserted in the electric connecting terminal.

3. An electric connecting terminal as recited in claim 1, wherein each layer of the resilient connecting portion is of equal width.

* * * * *